United States Patent [19]

DeHaven

[11] Patent Number: 4,814,781

[45] Date of Patent: Mar. 21, 1989

[54] SATELLITE DISH DRIVE MECHANISM

[76] Inventor: Benjamin A. DeHaven, 35945 94th St. East, Littlerock, Calif. 93543

[21] Appl. No.: 90,260

[22] Filed: Aug. 27, 1987

[51] Int. Cl.[4] ..... H01Q 3/2

[52] U.S. Cl. ..... 343/766; 343/882

[58] Field of Search ..... 343/765, 766, 882, 757, 343/840, 878, 880; 248/183

[56] References Cited

U.S. PATENT DOCUMENTS

| | | | |
|---|---|---|---|
| 4,282,529 | 8/1981 | Speicher | 343/766 |
| 4,663,635 | 5/1987 | Wu | 343/765 |
| 4,692,771 | 9/1987 | Rothbarth et al. | 343/766 |

*Primary Examiner*—William L. Sikes
*Assistant Examiner*—Michael C. Wimer
*Attorney, Agent, or Firm*—Milton S. Gerstein

[57] ABSTRACT

An improved drive for a satellite dish assembly. A flat, steel arc is fixedly connected at its two ends to the pivotal frame of the dish assembly, which steel arc is provided with a series of rows of mini-gear teeth on its outer surface. The steel arc is sandwiched between a rotatable knurled hub and a roller bearing, which knurled hub is provided with a series of rows of mini-diamond-shaped recesses for meshing engagement and forming of the gear teeth of the steel arc, in order to pivot the steel arc, and, therefore, the frame and dish mounted thereto, through a desired arc for aiming the satellite dish. The knurled hub is driven by a motor assembly, the motor assembly, knurled hub, and bearing being mounted to a free end of a cantilevered support arm, the other end of which is fixedly connected to a housing for the pivot shaft of the dish assembly about which the frame and satellite dish rotate for aiming purposes.

10 Claims, 2 Drawing Sheets

FIG. 3
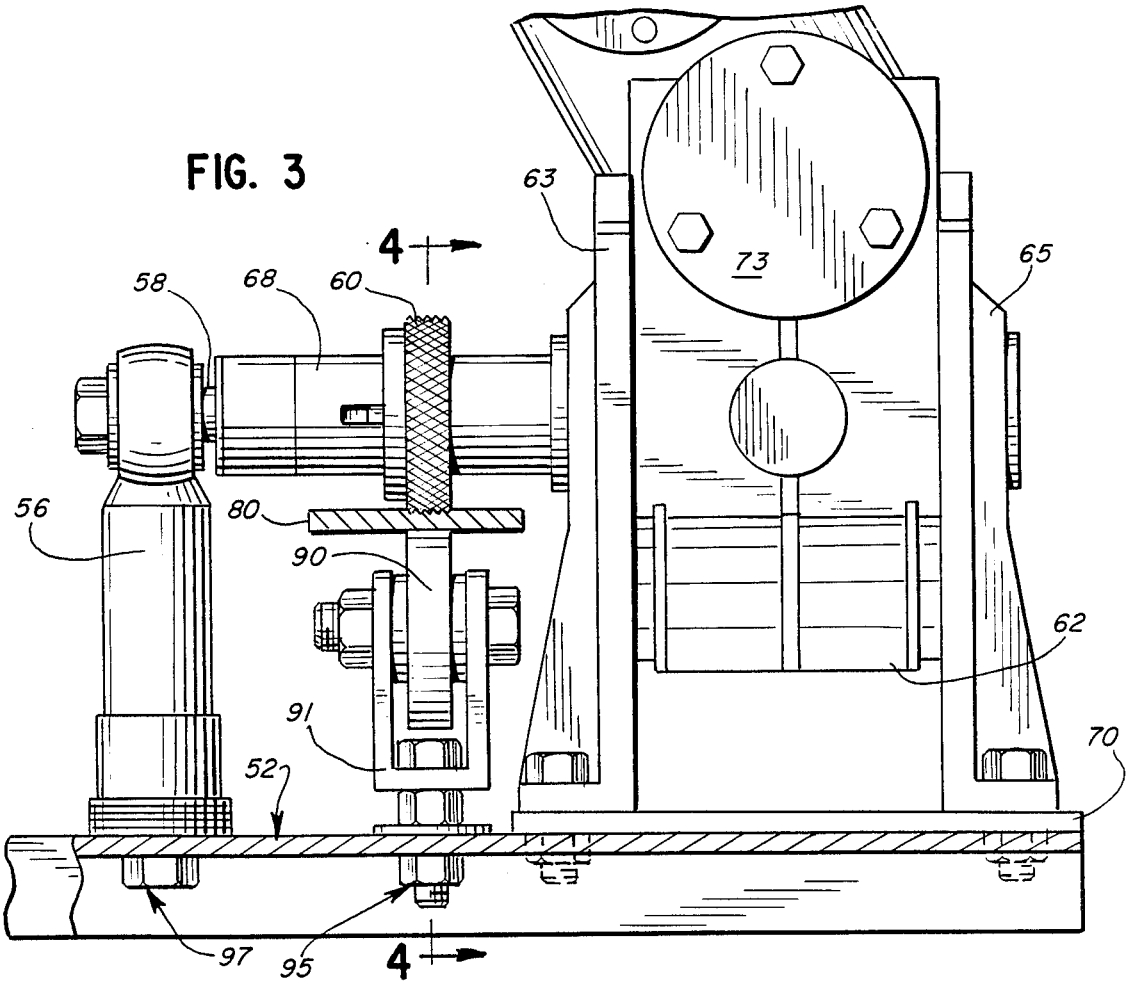
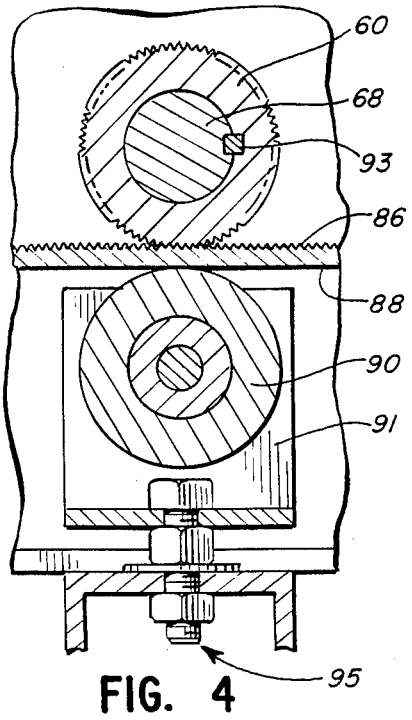
FIG. 4
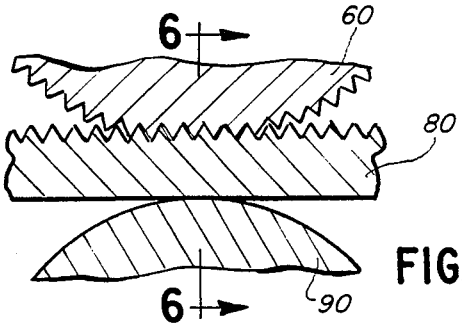
FIG. 5
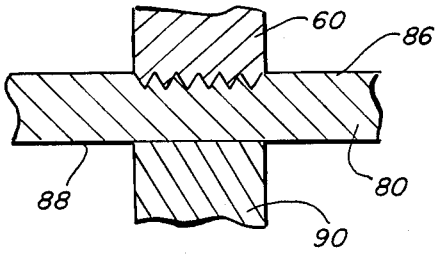
FIG. 6

SATELLITE DISH DRIVE MECHANISM

BACKGROUND OF THE INVENTION

The present invention is directed to a drive mechanism for rotating a satellite dish assembly through an arc of between 165° and 180°. Presently used drive assemblies are of the linear actuator type or the "horizon-to-horizon mount" type. The linear actuator type is either a manually operated screw jack or also may include a motor drive therefor. A common problem with this type of drive is that often the weight of the satellite dish or severe weather may damage the drive assembly. The linear actuator has a movable shaft which is pivotally connected at one end to the dish frame, and which must be protected from moisture and dust, as well as freezing temperatures. A small amount of wear or looseness at the pivots or in the drive screw causes extreme aiming problems, such that the dish assembly may no longer be directed skyward at the proper azimuth.

The horizon-to-horizon type of assembly employs heavy duty, close tolerance gearing directly mounted to the dish assembly, or alternatively uses sprockets and chains. These types of drives perform well, and are accurate in the long term, but are quite expensive. Precision gear boxes, isolated from ambient conditions, generally are free from dust and dirt problems. However, there are very expensive. Open drives are not isolated, and, therefore, suffer from damage due to ambient conditions. Thus, premature wear occurs. Further, there exists the same problem with all prior art types of assemblies, in that wear causes looseness, which magnifies slack, and thus compounds aiming problems.

SUMMARY OF THE INVENTION

It is, therfore, main objective of the present invention to provide a drive assembly for a satellite dish that allows for greater aiming accuracy even after wear has occurred therein.

It is another objective of the present invention to provide an improved drive assembly for a satellite dish that allows for such improved aiming accuracy for all positions of the satellite dish along its arc of travel.

It is another objective of the present invention to provide such a drive assembly for a satellite dish that is relatively free from climatic conditions as well as dust and dirt.

It is yet another objective of the present invention to provide such an improved drive assembly at a low cost as compared to the horizon-to-horizon types and the linear actuator types.

Toward these and other ends, the improved satellite dish drive assembly includes a pinch roller drive having a knurled outer surface forming openings which mesh with an arcuate member having an upper surface provided with mating teeth for meshing engagement in the recesses of the knurled pinch roller,or hub. The assembly includes a mounting structure for mounting the roller to the satellite dish assembly's frame, so that as the dish rotates through its arc, the arcuate member rotates with it, with the roller and mounting assembly remaining stationary, by virtue of the fact that the upper end of the mounting structure, or arm, is affixed to, or coupled to, a central brace member in which is mounted the pivot shaft for the dish assembly and about which it rotates through its angular arc of between 165° and 180°. The lower end of the mounting arm supports the knurled roller, drive motor assembly, and a support bearing mounted directly below the knurled roller or hub, so that the toothed arcuate member is sandwiched between the knurled roller and the support bearing, to thereby allow for proper pressure between the toothed arcuate member and the knurled member by means of adjustable bolts for the roller, mounting arm, and associated drive motor assembly mounted on a retaining plate affixed to the lower end of the mounting arm. Thus, wear of parts does not adversely affect the the connection between the teeth, and for all positions of the dish assembly, the same aiming accuracy may be obtained in contradistinction to prior art mechanisms.

BRIEF DESCRIPTION OF THE DRAWING

The invention will be more readily understood with reference to the accompanying drawing, wherein:

FIG. 3 is a side elevation view, in partial cross section, of the knurled hub, bearing, flat steel arc, and motor assembly mounted at the free end of the support arm of the improved drive assembly of the invention;

FIG. 4 is a cross-sectional view taken along line 4—4 of FIG. 3;

FIG. 5 is a detail view showing the relationship between the knurled hub member, the bearing, and the flat steel arc of the improved drive assembly of the invention; and FIG. 6 is a cross-sectional view taken along line 6—6 of FIG. 5.

DETAILED DESCRIPTION OF THE INVENTION

Figure 1:
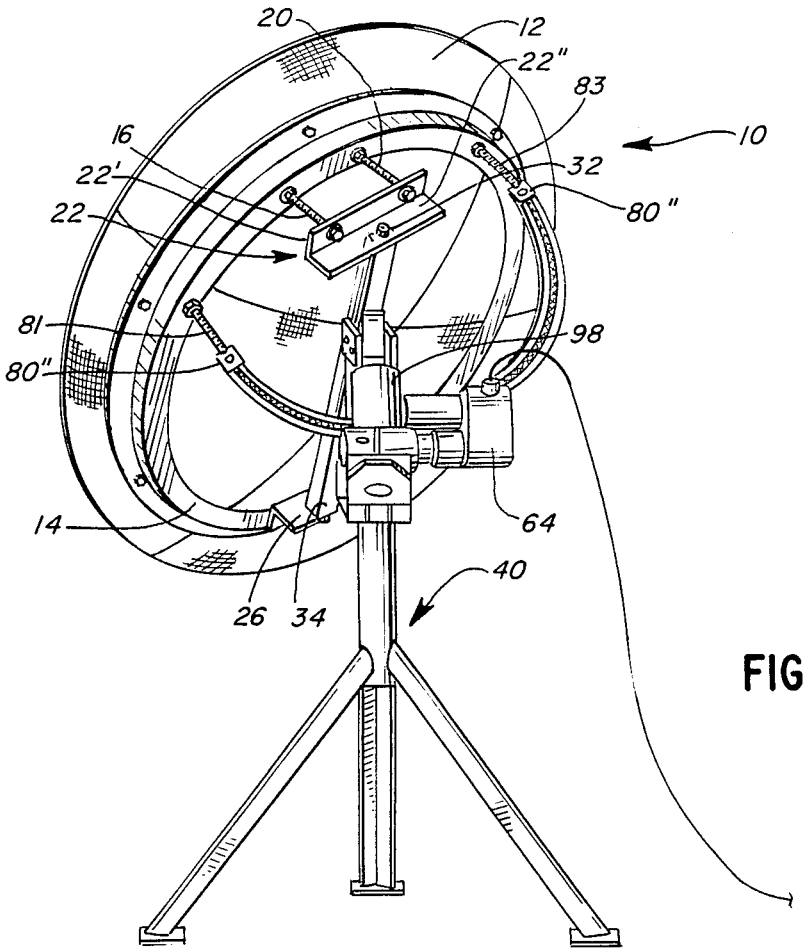
FIG. 1 is an isometric view of the improved satellite dish assembly and improved drive assembly therefor according to the invention.
Figure 2:
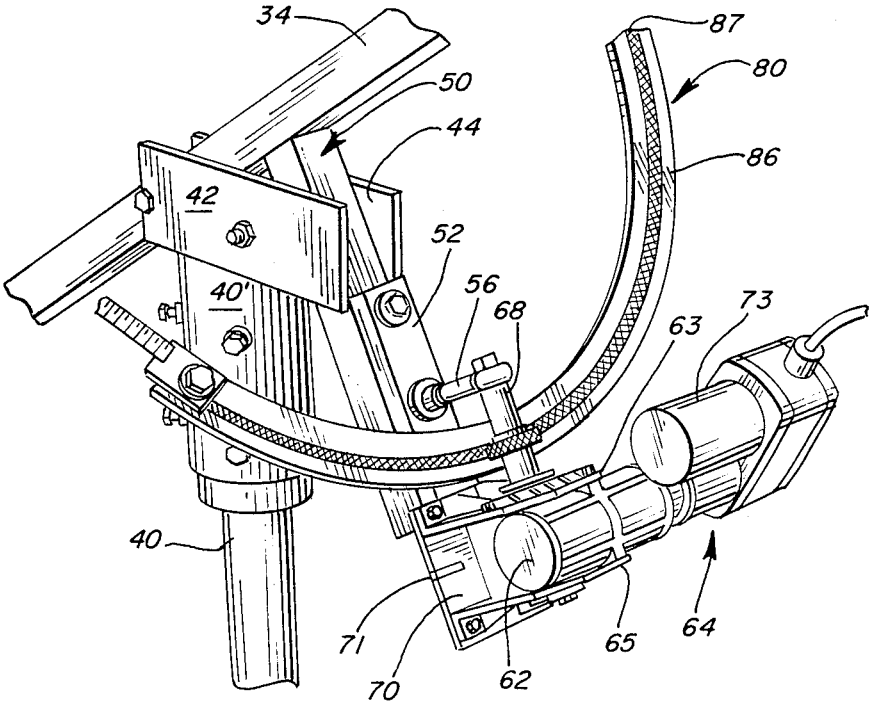
FIG. 2 is an isometric view showing in detail the improved drive assembly of the invention.

Referring now to the drawings in greater detail, there is shown in FIG. 1 a satellite dish assembly 10 incorporating therein the improved drive mechanism of the invention. The satellite dish assembly includes a conventional dish 12 with a circular rear frame 14. Connected to the frame 14, approximately at the top center portion thereof, are adjustable declination screws 16, 20, each screw being affixed at one end to the frame as shown in FIG. 1, with the other end of each screw being threadingly received in an L-shaped mounting bracket element 22 having a vertical portion 22', which vertical portion receives the other ends of the screws 16, 20 for adjustable angular positioning of the dish 12 relative to a plane parallel to the axis of rotation of the dish proper. The horizontal portion 22'', in conjunction with a similarly shaped bracket element 26, mount therebetween a polar pivot shaft 32 enclosed in a housing 34. The pivot shaft constitutes the polar axis about which the frame 14 and dish 12 rotate or pivot, in an arc of approximately 165 degrees. A tripod, or other type, of support 40 supports the dish assembly on a flat surface, the support 40 having an upper end 40' mounted to brackets 42, 44, which brackets are affixed to the polar pivot housing 34, to constitute the stationary support of the assembly, as best seen in FIG. 2. It is to be understood that any type of stationary support may be used.

The improved drive mechanism of the present invention includes a cantilevered support or mounting arm 50. The upper or first end of the support arm 50 is fixedly connected to the undersurface of the rectilinear-shaped cross section of the pivot housing 34, as best seen in FIG. 2. The other end of the support arm 50 is free and suppots thereon the drive mechanism proper of the invention. A gusset plate 52 is affixed to the bottom portion of the support arm 50, which gusset plate mounts an upstanding rod support or pedestal 56 having an upper portion for mounting an upper end of a bearing rod 58, which rotatably mounts a knurled driving hub or disc 60 and associated shaft 68, so that the knurled hub may be rotated. The knurled hub 60 constitutes the main driving element of the mechanism according to the invention. The other, lower end of the rod 58 is mounted in an upstanding side plate 63. About the shaft 58 is the rotatable, driven output shaft 68 which is coupled to the knurled hub 60 via a key 93 (FIG. 4) and slot, so that the rotatable, driven output shaft 68 and knurled hub 60 are driven as one unit via a conventional gear box 62 and by a conventional motor assembly 64. The gear box 62 is mounted between side retaining plates 63, 65 and is supported on a flat plate 70 affixed to the distal free end of the gusset plate 52. The output shaft 68 is driven by the gear box assembly 62, its lower end being rotatingly mounted therein, and also having suitable gearing for meshing with the gears of the gear box assembly. The gear box and motor assembly also include a conventional Thompson-Saginaw input adapter 73.

The other main element of the drive mechanism is a curved or arched flat steel plate element 80 best seen in FIGS. 1 and 2. The arched flat plate 80 has a first end 80' fixed to a portion of the circular rear frame 14 by a conventional bolt 81, or the like, and a second end 80" fixed to another portion of the frame 14 via another bolt 83. The plate 80 is provided with an outer or upper flat surface 86 in which are formed mini-gear projections or teeth 87, the teeth 87 forming a curve or arch with the same radius of curvature as the plate 80 itself. The plate 80 also has an inner or lower flat surface 88 (FIG. 4). The plate 80 is so mounted to the frame 14 such that the upper and lower surface 86, 88 lie in parallel planes parallel to the longitudinal axis of the cantilevered support arm 50, such that the upper surface 86 and projecting teeth 87 thereof lie directly adjacent to, in meshing engagement with, and closer to the support arm 50 than, the knurled hub 60. A bearing support 90, best seen in FIG. 3, rotatably supports the lower flat surface 88 of the plate 80, so that the arched steel plate 80 is sandwiched between the knurled hub 60 and the bearing 90, whereby the steel plate is driven thereby. The bearing 90 is suitably supported by journal mount 91 in the conventional manner, on the gusset plate 52' of the support arm 50.

In the preferred embodiment, the knurled hub 60 is formed with an outer surface of diamond-shaped recesses that under pressure form mating and cooperating teeth or projections 87 on the upper flat surface 86 of the arched plate 80. Preferably, the outer surface of the knurled hub is provided with a series of rows of diamond-shaped recesses each having the same depth within the range of 0.020 in. and 0.050 in., with the preferred depth being 0.035 in. Each of the teeth or projections 87 projects outwardly the same distance and within the range of between 0.015 in. and 0.030 in., with the preferred being 0.020 in. The radius of curvature of the plate 80 and the knurled hub 60 depends upon the size and load of the dish assembly. For a pivoted load of less than 75 pounds, radius of curvature of the plate 80 is preferably 10 in., with a hub 60 of radius 1.25 in. For a load between 75 pounds and 225 pounds, the plate has a radius of 14 in., while the hub has a 1.50 in. radius. For loads between 225 pounds and 450 pounds, the plate has a radius of 18 in., while the hub has a radius of 1.75 in. In each case, the knurled hub is provided with diamond-shaped recesses of the linear density of 21/inch. For the first above-mentioned case, the plate also has thickness of 0.1046 in. and a width of 1.125 in., while the hub has a width of 5/16 in. For the second case, the plate has a thickness of 0.1345 in. and a width of 1.50 in, while the hub has a width of ½ in. For the last mentioned case, the plate has a thickness of 0.2242 in. and a width of 1.75 in., while the hub has a width of ⅝ in. FIGS. 4–6 show the manner of meshing engagement of the knurled hub's diamond-shaped recesses and the projections of the plate 80.

It may, therefore, be seen that upon rotation of the knurled hub 60, the arched flat steel plate 80 is caused to rotate about the pivot shaft 32, the frame, and therefore, the dish 12, also being rotated therewith.

The base plate 70 for the gear box 62 is provided with stress relief cuts so as to not impose unequal loads on the gear case assembly. Preferably, a pair of stress relief cuts 71 (FIG. 2) are made at the center of the plate, each from the middle of one edge surface toward the center of the plate, which edge surface of the plate is that parallel to the length of the support arm 50. As can be seen in FIG. 3, adjusting bolts 95 and 97 are used to mount the bearing and pedestal to the gusset plate 52. These bolts may be adjusted so that initially the knurled hub may impress or form in the upper surface of the plate 80 the mating, cooperating gear teeth or projections on the upper surface 86. Typically, between four and six passes of the knurled hub against the upper flat surface 86 will impress and form therein the minigear teeth 87, since the plate is made of hot-rolled, mild steel. A protective cover 98 may be used, as shown in FIG. 1, to help protect the drive mechanism from ambient conditions. It has been found that the repeatability aiming error is less than 1/10 of a degree under full conditions. Dry lubricant is used for exposed parts.

The drive mechanism of the invention obviates the prior art problem of slack forming, which has hitherto led to erroneous aiming of the satellite dish antenna. As long as there exists pressure on the steel arc 80 between the knurled hub and bearing, slack will be nonexistent, proper pressure being easily and readily achieved via the adjusting bolts 95, 97. Thus, wear of parts may be easily and readily accomodated, to thereby provide a drive mechanism capable of overcoming slack problems, and, thus, allow for consistent and relatively error-free aiming of the satellite dish antenna. While the invention has been disclosed for satellite dish azimuth control, the invention may also be used for elevation control of a satellite dish assembly.

While a specific embodiment of the invention has been shown and described, it is to be understood that numerous changes and modifications may be made therein without departing from the scope, spirit, and intent of the invention as set defined in the appended claims.

What is claimed is:

1. In a satellite dish assembly comprising a dish, frame means for supporting said dish, and mounting means for pivotally mounting said frame means, wherein the improvement comprises:

said mounting means comprising a pivot shaft means having a pivot shaft, the ends of said pivot shaft being pivotally connected to said frame means at diametrically opposed portions thereof, said frame means and said dish rotating through an arc about the axis defined by said pivot shaft; and drive means for rotating said frame means and said dish about said pivot shaft comprising a cantilevered support arm having a first end portion fixedly connected to a portion of said mounting means and a second free end, said support arm extending generally away from said frame means such that said second free end is spaced rearwardly of said dish a greater distance than said first end of said support arm;

said drive means further comprising a driving hub means rotatably mounted on said support arm adjacent said second free end, said driving hub means comprising drive engaging means, and means for mounting said driving hub means for rotation about an axis parallel to the length of said support arm as taken from said first end thereof toward said second free end thereof;

said drive means further comprising bearing means rotatably mounted adjacent said second free end of said support arm about an axis parallel to and spaced from said axis of said driving hub means such that said bearing means and said driving hub means are spaced from each other in operational relationship, and a driven arcuate means having a first end affixed to a first portion of said frame means and a second end affixed to a second portion of said frame means for conjoint movement therewith, said arcuate means having an outer surface face and an inner surface face, one of said outer surface face and said inner surface face comprising engagement means for cooperative engagement with said engaging means of said driving hub means to be driven thereby, said arcuate means being mounted such that a portion thereof is always positioned between said driving hub means and said bearing means for surface contact therebetween; and means for rotating said driving hub means to cause the rotational movement of said arcuate means, and, therefore, said frame means about said pivot shaft.

2. The improvement according to claim 1, wherein said driving hub means comprises a knurled hub, said drive engaging means comprising first gear teeth means projecting from the outer surface of said knurled hub means, said engagement means of said arcuate means comprising second gear teeth means for meshing engagement with said first gear teeth means.

3. The improvement according to claim 2, wherein said first gear teeth means comprises a series of rows of diamond-shaped recesses into which are received said second gear teeth means, said second gear teeth means comprising projecting gear teeth formed on said outer surface of said arcuate means.

4. The improvement according to claim 1, wherein said means for rotating comprises motor means mounted adjacent said second free end of said support arm, said drive means further comprising plate means mounted to said second free end of said support arm for mounting thereon said motor means, said motor means being operatively coupled to said driving hub means for rotating said driving hub means to cause said arcuate means and said dish to pivot about said pivot shaft.

5. The improvement according to claim 1, wherein said pivot shaft means further comprises a housing for mounting said pivot shaft, said first end of said support arm being fixedly connected to said housing.

6. The improvement according to claim 1, wherein said arcuate means is a generally thin, flat, circular steel arc having a thickness as measured between said outer and inner surface of between 0.10 and 0.25 inches and a radius of curvature of between 8 and 20 inches.

7. The improvement according to claim 6, wherein said driving hub means comprises a cylindrical knurled hub having a radius of between 1.0 and 2.0 inches, said engaging means thereof comprising a series of rows of diamond-shaped recesses into which project said engagement means of said arcuate means, each said diamond-shaped recess having a depth of between 0.020 and 0.050 inches; said engagement means of said arcuate means comprising a series of rows of cooperating projecting gear teeth for mating engagement in said diamond-shaped recesses, each said gear teeth projecting outwardly from between 0.015 and 0.030 inches.

8. In a satellite dish assembly comprising a dish, frame means for supporting said dish, and mounting means for pivotally mounting said frame means, wherein the improvement comprises:

said mounting means comprising a pivot shaft means having a pivot shaft, the ends of said pivot shaft being pivotally connected to said frame means at diametrically opposed portions thereof, said frame means and said dish rotating through an arc about the axis defined by said pivot shaft; and drive means for rotating said frame means and said dish about said pivot shaft comprising a cantilivered support arm having a first end portion fixedly connected to a portion of said mounting means and a second free end, said support arm extending generally away from said frame means such that said second free end is spaced rearwardly of said dish a greater distance than said first end of said support arm;

said drive means further comprising a driving hub means rotatably mounted on said support arm adjacent said second free end, said driving hub means comprising drive engaging means, and means for mounting said driving hub means for rotation about an axis parallel to the length of said support arm as taken from said first end thereof toward said second free end thereof;

said drive means further comprising bearing means rotatably mounted adjacent said second free end of said support arm about an axis parallel to and spaced from said axis of said driving hub means such that said bearing means and said driving hub means are spaced from each other in operational relationship, and an arcuate member having a first end affixed to a first portion of said frame means and a second end affixed to a second portion of said frame means for conjoint movement therewith, said arcuate member having an upper surface face and an lower inner surface face, said arcuate means being mounted such that a portion thereof is always positioned between said driving hub means and said bearing means for surface contact therebetween;

means for selectively and varyingly urging said bearing means toward and away from said driving hub means, said driving hub means comprising gear teeth recess means projecting from the outer surface thereof; said upper and lower surfaces of said arcuate member being flat; said means for urging selectively urging said upper surface of said arcuate member and said outer surface of said hub means into engagement, in order to initially form mating recesses in said upper surface via said gear teeth of said hub means; and means for rotating said driving hub means to cause the rotatinal movement thereof.

9. The improvement according to claim 8, wherein said means for urging comprises a pair of bolts mounted by said cantilevered support arm and operatively connected to said bearing means.

10. The improvement according to claim 9, wherein said gear teeth recess means comprises a series of rows of diamond-shaped recesses for forming in said upper surface diamond-shaped projections after said means for urging is operated to compress said hub means against said upper suface.

* * * * *